United States Patent [19]

Franceus

[11] Patent Number: 4,885,984

[45] Date of Patent: Dec. 12, 1989

[54] RADON REMOVAL APPARATUS

[76] Inventor: Paul E. Franceus, 449B Pine Bank Rd., Flemington, N.J. 08822

[21] Appl. No.: 245,588

[22] Filed: Sep. 19, 1988

[51] Int. Cl.[4] ..... F24F 7/06

[52] U.S. Cl. ..... 98/42.02; 98/42.07

[58] Field of Search ..... 98/1.5, 42.02, 42.06, 98/42.07, 42.09, 42.13, 116; 417/63

[56] References Cited

U.S. PATENT DOCUMENTS

| | | | |
|---|---|---|---|
| 1,224,180 | 5/1917 | Lake | 98/1.5 X |
| 1,905,243 | 4/1933 | Rogers . | |
| 1,929,688 | 10/1933 | Hirschman | 98/42.07 |
| 2,159,498 | 5/1939 | Birkholz | 98/116 |
| 2,451,198 | 10/1948 | Molpus | 98/116 X |
| 2,494,124 | 1/1950 | Hegy | 417/63 X |
| 2,548,607 | 4/1951 | Jenn | 98/116 |
| 3,050,003 | 8/1962 | Edwards | 417/63 X |
| 3,415,178 | 12/1968 | Ball et al. | 98/42.06 |
| 3,473,462 | 10/1969 | Imming | 98/115.4 |
| 4,006,672 | 2/1987 | Matsuyoshi et al. | 98/116 X |
| 4,245,965 | 1/1981 | Brown | 417/360 |
| 4,504,751 | 3/1985 | Meier | 310/62 |
| 4,527,953 | 7/1985 | Baker et al. | 417/63 X |
| 4,553,075 | 11/1985 | Brown et al. | 318/254 |
| 4,563,622 | 1/1986 | Deavers et al. | 318/254 |
| 4,596,585 | 6/1986 | Moeller et al. | 55/2 |
| 4,604,111 | 8/1986 | Natale | 55/97 |

OTHER PUBLICATIONS

"Radon Reduction Techniques for Detached Houses", *Technical Guidance,* EPA/625/5-86/019, U.S. Environmental Protection Agency, Jun. 1986.

*Primary Examiner*—Harold Joyce

*Attorney, Agent, or Firm*—Robert A. Green; Abraham Wilson

[57] ABSTRACT

The radon removal system includes one or more pipes coupled to the source of radon gas beneath the basement floor in a building. The pipes are coupled through the side wall of the basement to a fan which draws the radon out of the basement and away through piping coupled to the fan housing. The fan has a DC motor which is current limited to improve its operation. In addition, a vacuum switch is provided in the fan housing to sense proper operation of the fan. The switch is coupled to a signal light at the power cord inside the basement to indicate when the fan is operating properly.

8 Claims, 2 Drawing Sheets

RADON REMOVAL APPARATUS

BACKGROUND OF THE INVENTION

In recent years it has been found that decaying radium in the ground beneath buildings has been releasing radon gas into the building through the basement floor. This problem can be solved by venting the basement by means of a fan and thus removing the radon present in the basement. Up to this time the apparatus used for this process has included a fan placed in line with a pipe which extends from beneath the basement floor and through the side wall of the basement. The fan draws radon from beneath the floor through the pipes to the outside air. This is satisfactory, to some extent, if the fan is sealed and if the pipes are sealed to prevent radon from leaking into the basement after it is pulled from beneath the basement floor. However, leaks develop and such systems are thus not completely satisfactory.

SUMMARY OF THE INVENTION

The problem set forth above is solved, according to the invention, by the provision of one or more pipes extending from beneath the basement floor and through the side wall of the basement to a fan mounted externally to the building on the outside wall of the basement. With this arrangement, there is essentially no opportunity for leaks to permit radon to escape into the basement. The fan of the invention has several features, to be described, which render it unique for outdoor installation and for removing radon from beneath a building.

DESCRIPTION OF THE INVENTION

Figure 1:
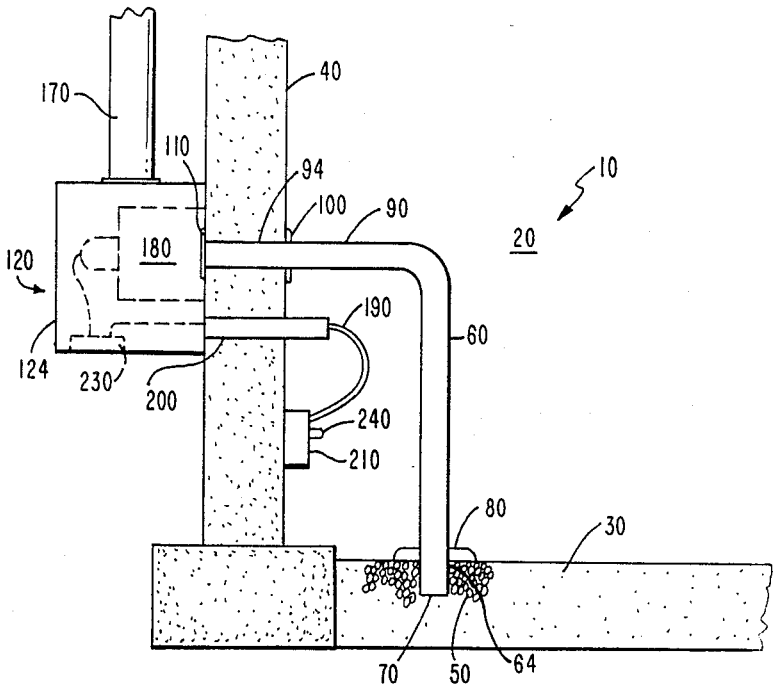
FIG. 1 is a side elevational view, partly in section of a portion of a building in which the system of the invention is installed.
Figure 3:
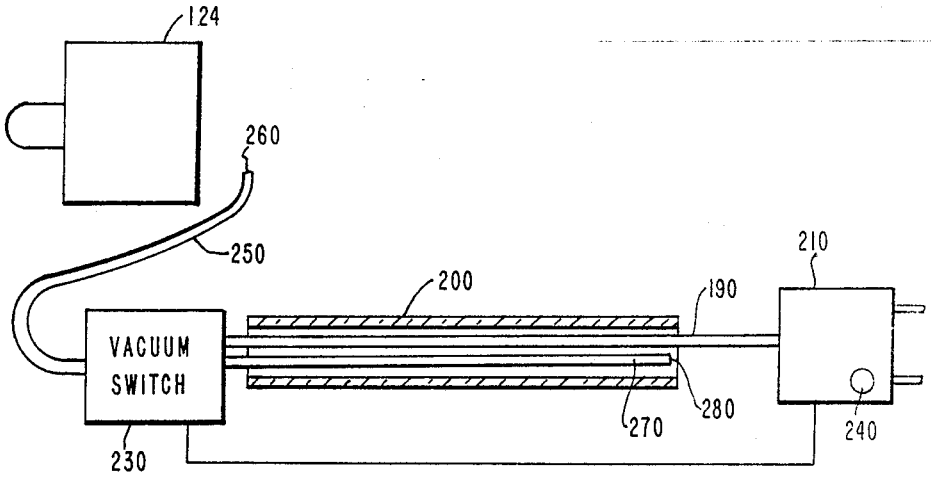
FIG. 3 is an enlarged schematic view of a portion of the system of FIG. 1.

A radon removal system 10 embodying the invention is described with respect to a home or other building having a basement 20 with the floor 30 of the basement and one side wall 40 being shown. Typically, gravel or dirt 50 is found beneath the floor 30 of the basement. A vertical pipe 60 of metal or plastic is inserted into a hole 64 in the basement floor with its lower end 70 in the gravel 50 beneath the floor and it is sealed gas-tight in the floor by seal 80. The pipe 60 is of a suitable height and at its upper end it bends and its horizontal portion 90 extends through a hole 94 in the side wall in which it is also sealed in any suitable fashion by seal 100. The outer end 110 of the horizontal portion 90 of the pipe 60 is secured to a fan 120 which is secured to the outer wall of the wall 40 of the building.

The fan 120 includes a weatherproof housing 124 of metal, plastic or any suitable material. The housing 124 includes an opening 130 in one side wall 140 in which the end 110 of pipe 60 is sealed, gas tight. The housing 124 also includes an opening 150 in its top wall 160 in which a vertical outlet pipe 170 is sealed, gas tight. The pipe 170 extends vertically above the roof of the building. Opening or hole 150 can also be in the bottom wall or a side wall of the housing.

Inside the housing 124 is mounted a fan 180 oriented to draw air through pipe 90 into the fan and out the outlet pipe 170.

The fan 180 may be a conventional 110 volt, A.C. fan but according to the invention, the fan is preferably a fan which has a D.C. motor with a 12 volt, or less, motor being satisfactory. Suitable motors are made by Dayton Electric Manufacturing Company. One advantage of a low voltage D.C. motor is that it is safer than a 110 volt A.C. motor as is well known. In addition, a current limiter is provided and the speed of operation of this D.C. motor will vary with the load, that is with the resistance to air flow into the end 70 of pipe 60 . Thus, if there is high resistance, the fan motor will run faster and if resistance is low the fan motor will run more slowly. An A.C. motor runs at the same speed at all times.

Figure 2:
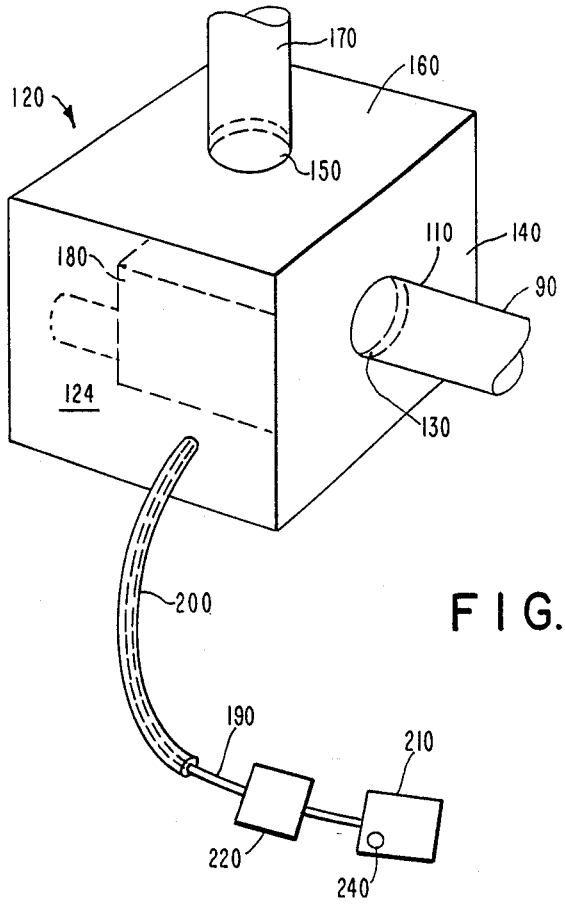
FIG. 2 is perspective view of a fan used in the system shown in FIG. 1.

The wiring 190 for the fan motor run through a protective, flexible tube 200 which extends from the fan housing 124 (FIGS. 1 and 2) through the wall 40 for a short distance into the basement area. The wires 140 from the fan then continue on to a plug 210 which can be inserted into a normal 110 volt A.C. outlet inside the basement.

Figure 4:
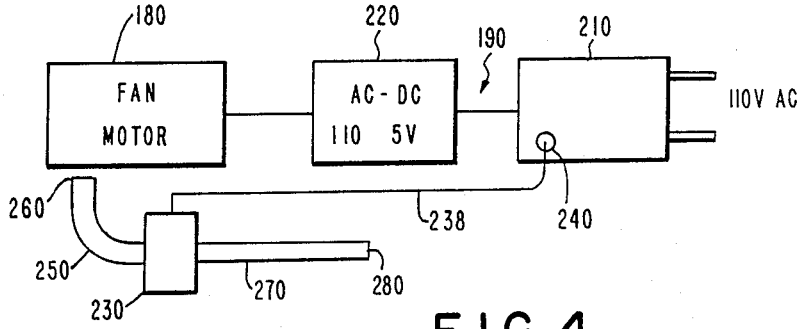
FIG. 4 is a schematic representation of some of the electrical components of the system of the invention.

The electrical circuitry of the invention is shown schematically in FIG. 4 and includes the line cord plug 210 connected to 110 volt A.C. from which the power cord 190 extends from plug through the tube 200 through a converter board 220 located inside the fan housing, which converts the 110 volt A.C. to 12 volt D.C. The converter board 220 will also include a current limiting circuit which is designed to limit the current to 2.5 amperes or so. The converter board 220 may also be located inside the building if desired adjacent to or in the plug 210.

According to the invention, a vacuum switch 230 is mounted inside the fan housing and it is connected electrically by wiring 238 to an indicator light 240 mounted on the line cord plug 210 or in a separate box with the converter, so that it is visible inside the basement. The vacuum switch 230 includes a first tube 250 having an end 260 positioned adjacent to the inlet to fan 180 to sense air pressure at the inlet to the fan and a second tube 270 positioned inside the protective tube 200 and terminating inside the basement at 280 to sense air pressure inside the basement. When the fan is operating properly and is drawing air through pipe 60, the vacuum switch 230 senses a pressure differential at the two tubes 250 and 270 and closes and turns on the light 240 in line cord plug 210.

In operation of the system of the invention, radon gas, if present beneath the basement floor is drawn by the fan 180 from beneath the basement floor 30 into sealed pipe 60, through the fan and out through pipe 170. Since one continuous pipe, or several continuous pipes, are present within the basement, there can be no leak of radon from the pipe or from the system. In addition, if the fan 180 is operating properly, this is sensed by the vacuum switch 230 and the light 240 turns on.

Various modifications may be made in the system described within the scope of the invention. As already noted, more than one pipe may be connected to beneath the floor of the basement to draw radon therefrom. Other modifications will occur to those skilled in the art.

What is claimed is:

1. A gas venting system for a building including a basement, a basement floor and a side wall comprising a single continuous pipe having one end disposed beneath the basement floor and the other end extending through the side wall of the building, a fan coupled to the outer wall of the side wall of the building, said pipe being secured to said fan, a pipe extending from said fan vertically to draw gas pulled by the fan away from the building, and a low voltage D.C. motor coupled to and driving said fan and including a current limiter, the speed of operation of said motor varying with the load on said motor, with the speed increasing as the load increases.

2. The system defined in claim 1 wherein said fan includes electrical wiring which extends from the fan through the side wall of the building to a line cord plug inside the building.

3. The system defined in claim 2 and including a protective flexible tube enclosing said electrical wiring and extending from said fan through said side wall into the basement of the building.

4. The system defined in claim 2 and including a vacuum switch positioned in operative relation with said fan to sense air flow drawn by said fan, said vacuum switch being electrically connected to a signal light in said power cord plug.

5. The system defined in claim 4 wherein said vacuum switch includes a first tube positioned in operative relation with said fan and a second tube extending into operative relation with the basement of the building to sense the flow of air caused by said fan.

6. The system defined in claim 1 and including a vacuum switch in operative relation with said fan for sensing when the fan is operating properly and drawing air.

7. The system defined in claim 1 and including a line cord adapted to be connected at one end to 110 volt A.C. house power and extending through an electrical converter which converts said 110 volt A.C. to low voltage D.C.

8. The system defined in claim 7 and including in said converter a current limiter.

* * * * *